US005934649A

United States Patent [19]

Drane

[11] Patent Number: 5,934,649

[45] Date of Patent: Aug. 10, 1999

[54] HAND OPERATED POST AND POLE EXTRACTION DEVICE

[76] Inventor: Scott Loren Drane, P.O. Box 59192, Riyadh, Saudi Arabia, BMEL 03 V808

[21] Appl. No.: 09/075,910

[22] Filed: May 11, 1998

[51] Int. Cl.[6] ..... E21B 19/00

[52] U.S. Cl. ..... 254/30; 254/131; 254/120; 254/132

[58] Field of Search ..... 254/30, 113, 116, 254/119, 120, 131, 132, 133, DIG. 4

[56] References Cited

U.S. PATENT DOCUMENTS

| | | | |
|---|---|---|---|
| 1,083,614 | 1/1914 | Hunter | 254/131 |
| 1,234,243 | 7/1917 | Williams | 254/131 |
| 1,392,885 | 10/1921 | Battelle | 254/131 |
| 1,761,675 | 6/1930 | Mick | 254/132 |
| 2,252,797 | 8/1941 | Allen | 254/131 |
| 2,521,266 | 9/1950 | Swisher | 254/131 |
| 4,334,669 | 6/1982 | Ross | 254/131 |
| 4,365,786 | 12/1982 | Osteen | 254/30 |
| 4,695,037 | 9/1987 | Hadbavny | 254/131 |
| 5,186,437 | 2/1993 | Scott | 254/30 |
| 5,775,674 | 7/1998 | Bigham | 254/131 |

*Primary Examiner*—David A. Scherbel
*Assistant Examiner*—Lee Wilson
*Attorney, Agent, or Firm*—Michael I. Kroll

[57] ABSTRACT

A hand operated post and pole extraction device for removing a pole or post from the ground. The device includes a frame assembly having a base section, a vertical frame member extending therefrom and a plurality of leverage arms each extending along the length of and substantially perpendicular to the vertical frame member. A handle assembly is pivotally held atop one of the plurality of leverage arms and a chain assembly is removably connected to one end of the handle assembly. When the chain assembly is wrapped around the pole or post and a force is applied to one end of the handle assembly towards the ground, the handle assembly is caused to pivot about the leverage arm applying a force to the opposite end connected to the chain assembly and the pole or post in a direction away from the ground causing the pole or post to be extracted from the ground. The frame assembly also includes an upright support member extending at an angle from the vertical frame member providing additional support thereto. The handle assembly includes a handle section, an extension arm removably connected thereto and a leverage assembly for engaging the frame and chain assemblies. The leverage assembly includes a plurality of perpendicular rods integrally connected thereto wherein the leverage bar is removably positioned between adjacent ones of the plurality of perpendicular rods when the handle assembly is positioned thereon and a hook positioned at one end thereof for engaging the chain assembly.

8 Claims, 7 Drawing Sheets

HAND OPERATED POST AND POLE EXTRACTION DEVICE

BACKGROUND OF THE INVENTION

1. Field of the Invention

The present invention relates generally to devices for removing posts and poles implanted in the ground and, more specifically, to an easily transportable hand operated device for extracting posts and poles set in the ground.

2. Description of the Prior Art

Numerous devices for extracting objects set in the ground have been provided in the prior art. For example, U.S. Pat. Nos. 3,734,463; 3,946,988; 4,792,120 and 4,893,783 are illustrative of such prior art. Thus, while these units may be suitable for the particular purpose to which they address, they would not be as suitable for the purposes of the present invention as heretofore described.

U.S. Pat. No. 3,734,463

Inventor: Dennis J. Enright

Issued: May 22, 1973

A chain-snubbing and pole-gripping device for a pole-raising apparatus for raising wooden and other electric power line poles, telephone poles and the like, out of the ground, without substantial damage to the pole, embodying a toothed chain-snubbing and pole-gripping member which is adapted to be driven partially into the body of a wooden pole, somewhat above the ground level. In the use of the chain-snubbing and pole-gripping device, a flexible means, preferably in the form of a flexible chain member, encircles the pole and extends over the chain-snubbing and pole-gripping device, and fluid power-operated means in the form of a hydraulic or pneumatic piston-cylinder device is provided for raising the flexible chain member, thereby causing the flexible chain member to grip the chain-snubbing and pole-gripping device and thus raise the pole a predetermined increment. The operation may be repeated by removing the chain-snubbing and pole-gripping device from the pole and relocating it on the pole at a lower level until the pole is completely raised out of the ground in successive increments.

U.S. Pat. No. 3,946,988

Inventor: Jakob Kehren

Issued: March 30, 1976

A device for extracting trees, stumps and the like obstacles from the ground of the type having a pressure medium cylinder supported on a stand and with a holding member carried by its piston rod is provided which permits manual operation, the piston rod being spaced from the holding member and connected to a guide member for contacting the obstacle, and a holding member with a holding link for gripping the partly pulled out obstacle being rigidly mounted on the pressure cylinder.

U.S. Pat. No. 4,792,120

Inventor: Roy B. Egaas

Issued: December 20, 1988

Device for extracting and pulling posts, poles and the like having a tool body portion including a back wall, side walls and lower end surfaces. A hollow handle extends upwardly from the tool body and includes a slug metal member at the lower end of the handle. Teeth are secured to the lower edge surface of the back wall. A slide hammer bar is adapted to be inserted in the hollow handle to pound the tool body down and to pound the teeth into engagement with the post. The bar also acts as a lever extension of the handle for prying the post up once the device has been positioned and engaged with the post.

U.S. Pat. No. 5,695,162

Inventor: James DiCastro

Issued: December 9, 1997

A tree and tree stump removal apparatus consisting of a frame, pivotally mounted hydraulic cylinder mounted thereon, and a chain for placing around a tree or tree stump is provided. The hydraulic cylinder is pivotally mounted on the frame to provide the optimum vertical pulling force in order to quickly and effectively remove trees and tree stumps and their associated roots from the ground. An associated method for removing trees and tree stumps is also provided.

SUMMARY OF THE PRESENT INVENTION

The present invention relates generally to devices for removing posts and poles implanted in the ground and, more specifically, to an easily transportable hand operated device for extracting posts and poles set in the ground.

A primary object of the present invention is to provide a hand operated post and pole extraction device that will overcome the shortcomings of prior art devices.

Another object of the present invention is to provide a hand operated post and pole extraction device which is compact in construction and easily handled by a single person.

A further object of the present invention is to provide a hand operated post and pole extraction device which is able to efficiently and economically remove posts and poles set in the ground.

An additional object of the present invention is to provide a hand operated post and pole extraction device wherein the assembly is transportable and positioned in front of the post or pole to be extracted at a distance a chain connected thereto can be wrapped around the post or pole.

A further object of the present invention is to provide a hand operated post and pole extraction device which uses leverage and pivoting of a handle about a leverage point to extract the post or pole from its set position in the ground.

Another object of the present invention is to provide a hand operated post and pole extraction device that is simple and easy to use.

A still further object of the present invention is to provide a hand operated post and pole extraction device that is economical in cost to manufacture.

Additional objects of the present invention will appear as the description proceeds.

A hand operated post and pole extraction device for removing a pole or post from the ground. The device includes a frame assembly having a base section, a vertical frame member extending therefrom and a plurality of leverage arms each extending along the length of and substantially perpendicular to the vertical frame member. A handle assembly is pivotally held atop one of the plurality of leverage arms and a chain assembly is removably connected to one end of the handle assembly. When the chain assembly is wrapped around the pole or post and a force is applied to one end of the handle assembly towards the ground, the handle assembly is caused to pivot about the leverage arm applying a force to the opposite end connected to the chain assembly and the pole or post in a direction away from the ground causing the pole or post to be extracted from the ground. The frame assembly also includes an upright support member extending at an angle from the vertical frame member providing additional support thereto. The handle assembly includes a handle section, an extension arm removably connected thereto and a leverage assembly for engaging the frame and chain assemblies. The leverage assembly includes a plurality of perpendicular rods integrally connected thereto wherein the leverage bar is removably positioned between adjacent ones of the plurality of perpendicular rods when the handle assembly is positioned thereon and a hook positioned at one end thereof for engaging the chain assembly.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 4:
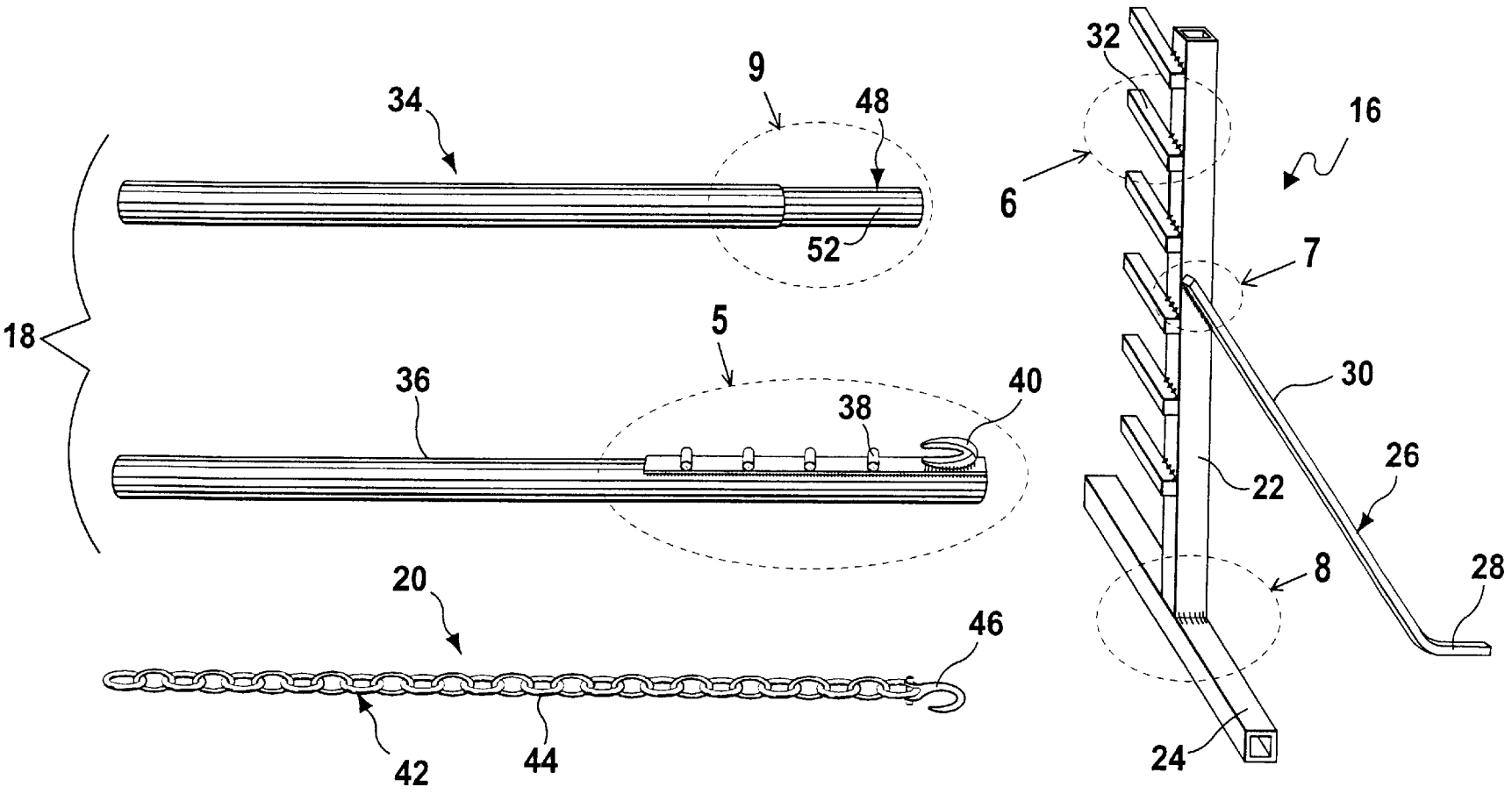
FIG. 4 is an exploded view of the components of the hand operated post and pole extraction device of the present invention.
Figure 8:
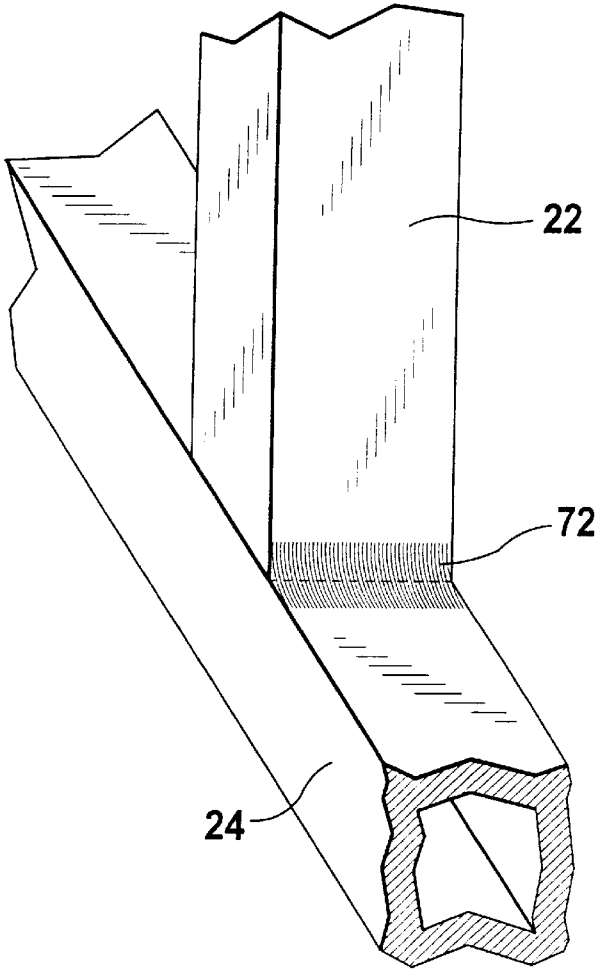
Figure 9:
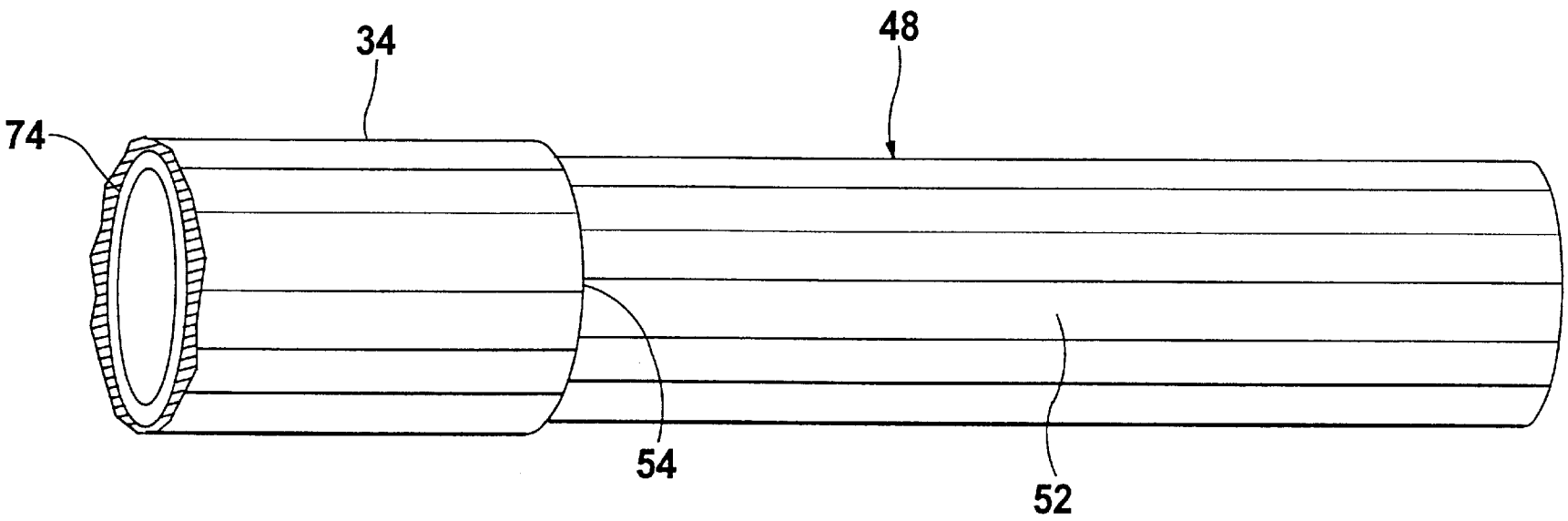

FIG. 8 is a side perspective view of the vertical frame member welded to the horizontal frame member of the hand operated post and pole extraction device of the present invention within the circle labeled 8 of FIG. 4; and FIG. 9 is a cut away view of the extender handle member and the sleeve welded thereto of the hand operated post and pole extraction device of the present invention within the circle labeled 9 of FIG. 4.

DESCRIPTION OF THE REFERENCED NUMERALS

Turning now descriptively to the drawings, in which similar reference characters denote similar elements throughout the several views, the Figures illustrate the hand operated post and pole extraction device of the present invention. With regard to the reference numerals used, the following numbering is used throughout the various drawing figures.

| | |
|---|---|
| 10 | hand operated post and pole extraction device |
| 12 | pole |
| 14 | ground in which pole is set |
| 16 | frame assembly |
| 18 | handle assembly |
| 20 | chain assembly |
| 22 | vertical frame member |
| 24 | horizontal frame member |
| 26 | upright support bar |
| 28 | base of support bar |
| 30 | angled section of support bar |
| 32 | horizontal leverage bars |
| 34 | handle section |
| 36 | extension arm |
| 38 | plurality of perpendicular rods |
| 40 | hook |
| 42 | chain |
| 44 | plurality of links forming chain |
| 46 | swivel connection |
| 47 | arrows indicating direction of pressure applied to handle assembly |
| 48 | connection bar |
| 49 | arrows indicating direction of pole or post being extracted |
| 50 | inner side of handle section |
| 52 | extending portion of connection bar |
| 54 | first end of handle section |
| 56 | first end of extension arm |
| 58 | leverage assembly |
| 60 | flat bar |
| 62 | weld securing the plurality of perpendicular rods to the flat bar |
| 64 | weld securing the hook to the flat bar |
| 66 | weld securing the flat bar to the extension arm |
| 68 | weld securing the horizontal leverage bar to the vertical frame member |
| 70 | weld securing the upright support bar to the vertical frame member |
| 72 | weld securing the vertical frame member to the horizontal frame member |
| 74 | weld securing the connection bar to the handle section |

DETAILED DESCRIPTION OF THE PREFERRED EMBODIMENT

Turning now descriptively to the drawings, in which similar reference characters denote similar elements throughout the several views, FIGS. 1–9 illustrate the hand operated post and pole extraction device of the present invention. The hand operated post and pole extraction device is indicated generally by the numeral 10.

Figure 1:
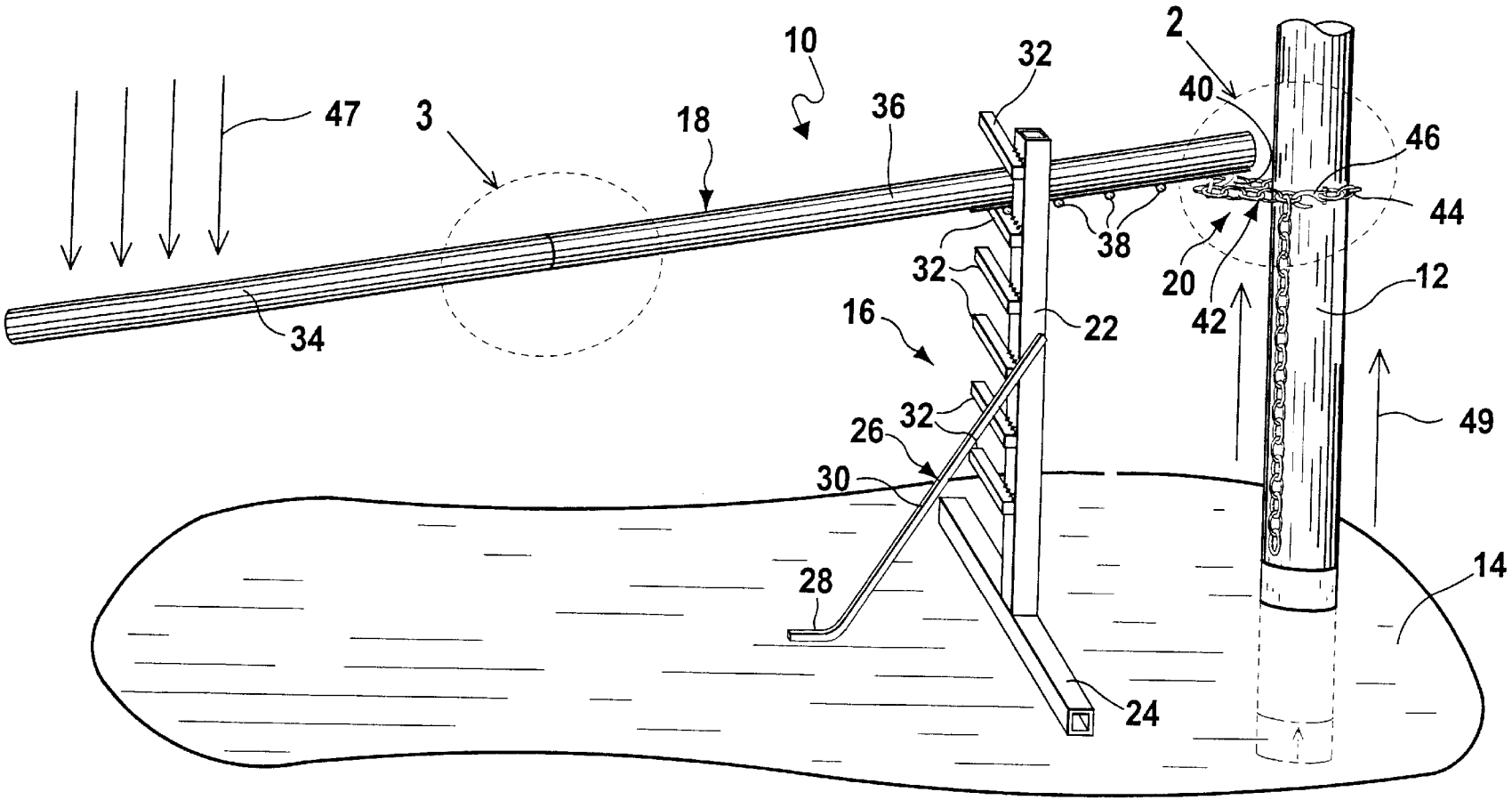
FIG. 1 is a front perspective view of the hand operated post and pole extraction device of the present invention in operation extracting a pole set in the ground.

The hand operated post and pole extraction device 10 of the present invention is clearly illustrated in FIGS. 1–9. In FIG. 1, the hand operated post and pole extraction device 10 is illustrated positioned in front of a pole 12 to be removed or extracted from its position set in the ground 14. The hand operated post and pole extraction device 10 includes a frame assembly 16, a handle assembly 18 and a chain assembly 20 interacting to extract the pole 12 from the ground 14.

The frame assembly 16 includes a vertical frame member 22 connected to extend at a substantially 90° angle from a horizontal frame member 24. An upright support bar 26 is connected to extend from the vertical frame member 22 and towards the ground 14. The upright support bar 26 includes a base section 28 and an angled section 30. The base section may include a flared section for providing a larger surface area with which to contact the ground 14 and provide additional support for the frame assembly 16. The base section is positioned at a distance from the horizontal frame member 24 and the angled section 30 extends at an angle from the base section 28. The angled section is secured at a side opposite the base section 28 to the vertical frame member 22 to provide additional support for the frame assembly 16 when extracting a pole 12. The angled section 30 preferably extends from the base section 28 at a substantially 60° angle. However, the angle at which the angled section 30 extends from the base section 28 need only be able to provide enough support to the frame assembly 16 for maintaining the frame assembly 16 in an upright steady position. Secured along the length of the vertical frame member 22 are a plurality of horizontal leverage bars 32. The horizontal leverage bars 32 provide a leverage or pivot point for the handle assembly 18 when extracting a pole 12 from the ground 14 as will be discussed hereinafter.

The handle assembly 18 is a two piece structure including a handle section 34 and an extension arm 36 secured thereto and extending therefrom. A plurality of spaced perpendicular rods 38 are secured and extend perpendicular to the extension arm 36. A selected one of the plurality of perpendicular rods 38 engages a selected one of the horizontal leverage bars 32 to hold the handle assembly 18 at a desired distance from the pole 12 to be extracted when in use. A hook 40 is secured to an end of the extension arm 36 opposite the connection to the handle section 34 and facing towards the plurality of perpendicular rods 38.

The chain assembly 20 includes a chain 42 consisting of a plurality of inter-engaging links 44 and a swivel connection 46 connected at one end thereof. In use, the chain 42 is wrapped around the pole 12 to be extracted and captured by the hook 40. The swivel connection 46 is then secured to one of the plurality of links 44 to thereby surround the pole 12. When a force is applied to the handle section 34 of the handle assembly 18 in the direction of the arrows labeled 47, the extension arm 36 is pivoted about the horizontal leverage bar 32 engaged with the selected one of the plurality of perpendicular rods 38. This causes a force to be applied to the chain assembly 20 in the direction of the arrows labeled 49 causing the pole 12 wrapped therein to also be moved in the direction of the arrows labeled 49. This force will act to extract the pole 12 from its position set in the ground 14.

Figure 2:
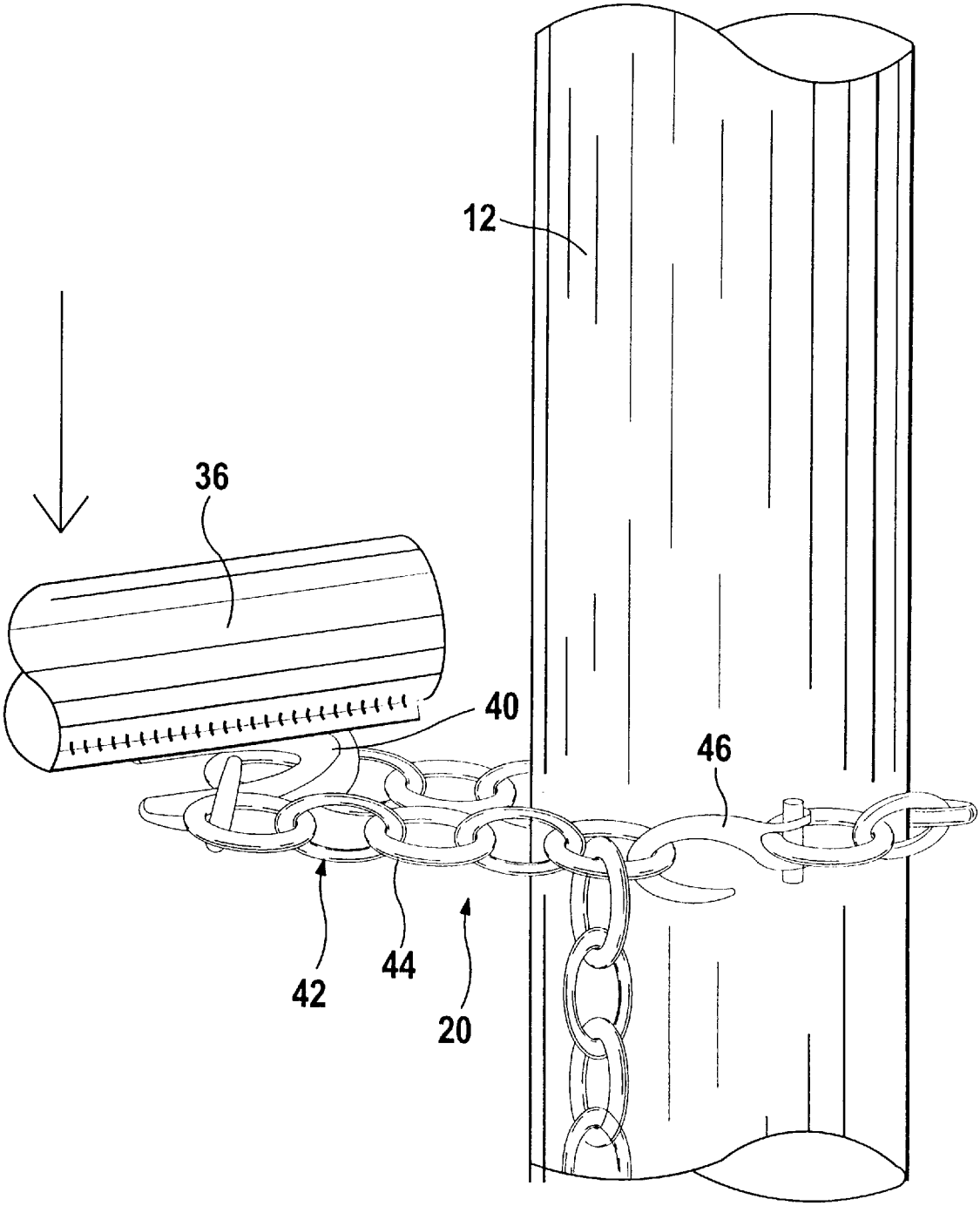
FIG. 2 is an exploded view of the attachment device used with the hand operated post and pole extraction device of the present invention taken from within the circle labeled 2 of FIG. 1.

FIG. 2 illustrates the interaction between the handle assembly 18 and chain assembly 20 when extracting a pole 12 from a set position. As can be seen from this view, the chain 42 is wrapped around the pole 12 and engaged with the hook 40 secured to the end of the extension arm 36. The swivel connection 46 is then engaged with one of the plurality of links 44 forming the chain 42 to secure the chain assembly 20 around the pole 12. When a force is applied to the handle section 34 of the handle assembly 18 as indicated by the arrows labeled 47 in FIG. 1, the extension arm 36 is caused to pivot in a direction opposite to the applied force. As the chain assembly 20 is engaged with the hook 40, it is caused to move with the extension arm 36. The movement of the chain assembly 20 in this direction applies a force in the direction of the arrows labeled 49 in FIG. 1 to the pole 12 surrounded by the chain 42 causing the pole 12 to be extracted from its set position in the ground 14.

Figure 3:
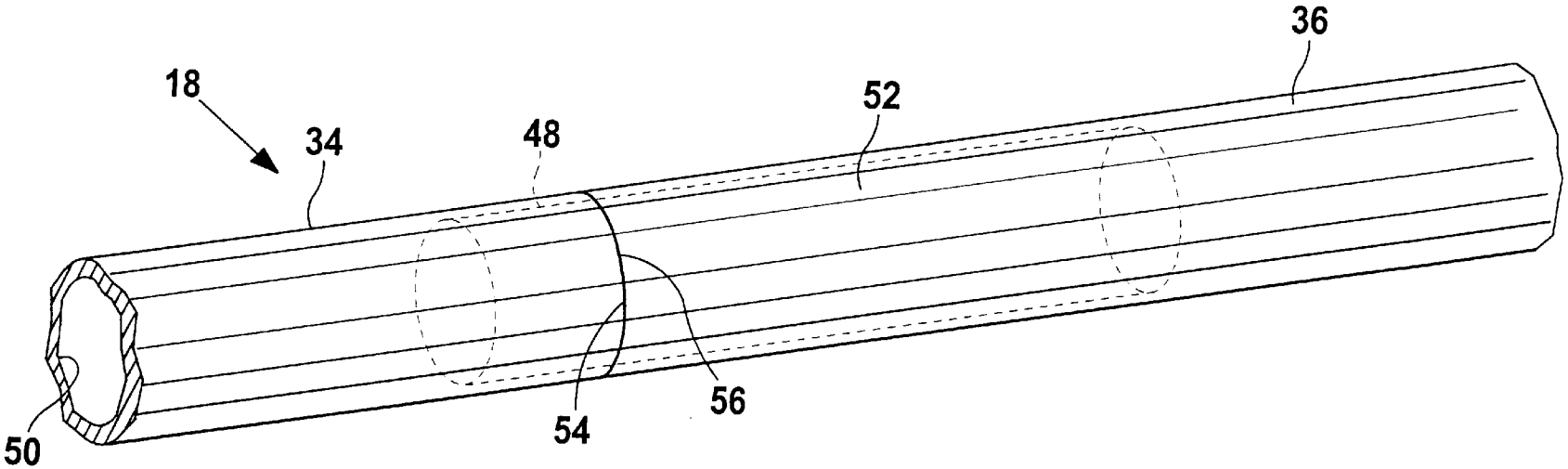
FIG. 3 is an enlarged side perspective view of the connection between the handle and extension arm used with the hand operated post and pole extraction device of the present invention.

The interconnection between the handle section 34 and the extension arm 36 of the handle assembly 18 is clearly illustrated in FIG. 3. As can be seen from this figure, both the handle section 34 and extension arm 36 are hollow poles. Preferably, both the handle section 34 and the extension arm 36 are two (2) inches in diameter. However, the diameter of the handle section 34 and the extension arm 36 may vary based upon the size and weight of the poles or posts to be extracted and the force needed to extract the posts or poles. The handle section 34 is preferably 32 inches in length and the extension arm 36 is preferably 42 inches in length. The lengths of both the handle section 34 and extension arm 36 may also vary due to the size and weight of the poles or posts to be extracted and the force needed to extract the posts or poles.

A connection bar 48 is secured to an inner side 50 of the hollow handle section 34. The connection bar 48 preferably extends approximately two (2) inches into the hollow handle section 34 and is welded therein. The connection bar 48 extends out from the inner side 50 of the handle section 34 whereby the extending portion 52 of the connection bar 48 is received within the hollow extension arm 36 when assembled for use. The extending portion 52 is preferably substantially seven (7) inches long whereby the entire connection portion 52 is received within the extension arm 36 such that a first end 54 of the handle section 34 contacts a first end 56 of the extension arm 36 when assembled for use.

FIG. 4 is an exploded view of the hand operated post and pole extraction device 10 of the present invention illustrating each element. The frame assembly 16 is illustrated in assembled form with all components secured in position. The interconnection of each of the components will be described hereinafter with reference to specific figures. The frame assembly 16 is preferably coated with a corrosion resistant material such as a non corrosion gray or black paint. The handle assembly 18 is illustrated in unassembled form with the handle section 34 and extension arm 36 separated. The chain assembly 20 is shown in an extended stretched out position. The chain 42 is preferably forty-two (42) inches in length and is preferably formed from a plurality of ¼ inch diameter links 44. The length of the chain 42 and diameter of the links 44 may vary based upon the intended use of the hand operated post and pole extraction device 10.

Figure 5:
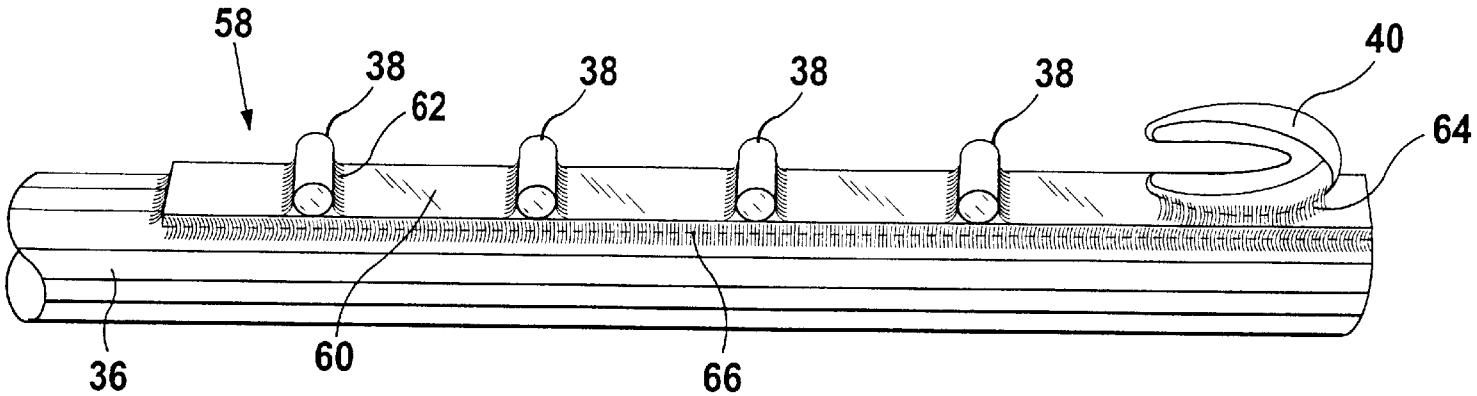
FIG. 5 is a side perspective view of the flat bar stock welded to one end of the handle of the hand operated post and pole extraction device of the present invention within the circle labeled 5 of FIG. 4.

FIG. 5 is an enlarged view of an end of the extension arm 36 including the leverage assembly 58. The leverage assembly 58 includes a flat bar 60 to which the horizontal rods 38 and the hook 40 are secured. A weld 62 is formed between the flat bar 60 and each of the plurality of perpendicular rods 38 to the flat bar 60. The plurality of perpendicular rods 38 are preferably one and one-half (1 ½) inches in length, five-eighths (⅝) inches in diameter and evenly spaced along the length of the flat bar 60. The hook 40 is also secured to the flat bar 60 by a weld 64 and the flat bar 60 is secured to the extension arm 36 by a weld 66.

Figure 6:
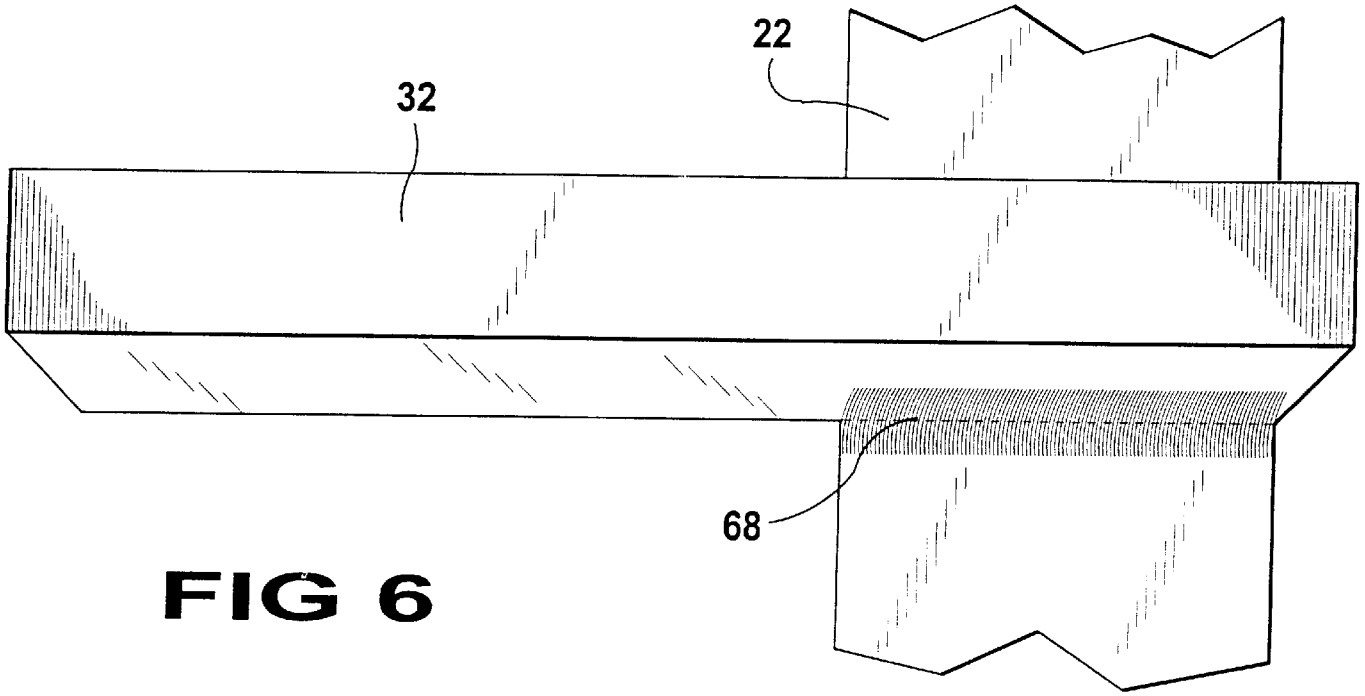
FIG. 6 is a side perspective view of the square bar stock welded to one end of the vertical frame member of the hand operated post and pole extraction device of the present invention within the circle labeled 6 of FIG. 4.

The connection between one of the plurality of horizontally extending bars 32 and the vertical frame member 22 is illustrated in FIG. 6. Each of the plurality of horizontally extending bars 32 are secured to the vertical frame member 22 in a similar manner and are preferably evenly spaced along the length of the vertical frame member 22. The plurality of horizontally extending bars 32 are secured to the vertical frame member 22 at a point one-half (½) inch off of the center by a weld 68 formed therebetween. A first of the plurality of horizontally extending bars 32 is positioned approximately three (3) inches from a base of the vertical frame member 22. The remaining ones of the plurality of horizontally extending bars 32 are spaced approximately four (4) inches apart along the length of the vertical frame member 22.

Figure 7:
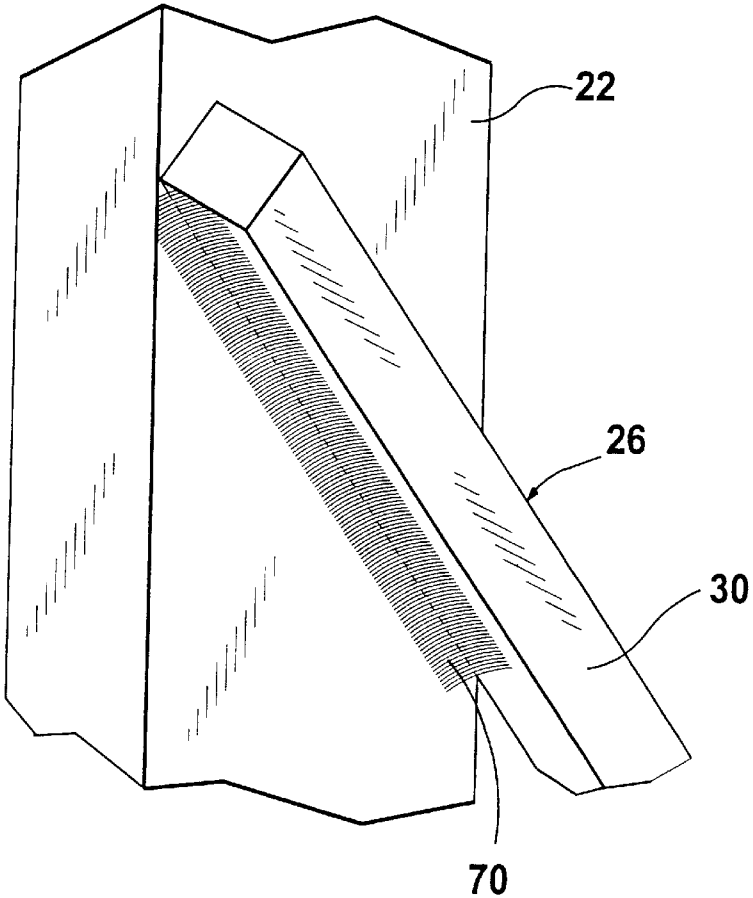
FIG. 7 is a side perspective view of the frame support bar welded to the vertical frame member of the hand operated post and pole extraction device of the present invention within the circle labeled 7 of FIG. 4.

The connection between the upright support bar 26 and the vertical frame member 22 is illustrated in FIG. 7. From this figure it is seen that the upright support bar 26 is connected to the vertical frame member 22 by welding as evidenced by the weld 70. The weld 70 is approximately eight (8) inches below the top of the vertical frame member 22 and extends at an angle equal to the angle of the angled section 30 of the upright support bar 26.

The connection between the vertical frame member 22 and the horizontal frame member 24 is illustrated in FIG. 8. From this figure it is seen that the vertical frame member 22 is also connected to the horizontal frame member 24 by welding as evidenced by the weld 72 to form an integral frame support for the hand operated post and pole extraction device 10. The weld 70 is preferably formed in a substantially central section of the horizontal frame member 24 to form a T-shaped frame support.

FIG. 9 illustrates the interconnection of the handle section 34 and the connection bar 48. As previously mentioned, the handle section 34 is hollow and the connection bar 48 is of a circumference able to fit within the hollow handle section 34. The connection bar 48 is positioned to extend approximately two (2) inches into the hollow inside of the handle section 34 wherein it is secured thereto by welding to form a weld 74 therebetween. The connection bar 48 is of a length able to extend from the hollow handle section 34 to provide an extension portion 52 for engaging the extending arm 36 to assemble the handle assembly 18.

The operation of the hand operated post and pole extraction device 10 in accordance with the present invention will now be described with reference to the figures. The hand operated post and pole extraction device 10 must first be assembled by interconnecting the frame assembly 16, the handle assembly 18 and the chain assembly 20. These assemblies are able to be disconnected to provide easy transport and storage for the hand operated post and pole extraction device 10.

Upon deciding to extract a pole or post 12 from the ground 14, the frame assembly 18 is positioned adjacent the pole or post 12 desired to be extracted. The distance at which the frame assembly 16 is positioned from the pole or post 12 is dependent upon the diameter of the pole or post 12 as the chain 42 must be long enough to be wrapped therearound. The frame assembly 16 is positioned with the upright support pole 26 extending on a side of the frame assembly 16 opposite the pole or post 12. The handle section 36 is then positioned so that the extension portion 52 of the connection bar 48 extends into the extension arm 36 to thereby assemble the handle assembly 18.

Once assembled, the handle assembly 18 is positioned between two of the horizontal leverage bars 32, resting on the leverage bar 32 therebelow so that the hook 40 extends on a side of the vertical frame member 22 opposite the handle section 34. The length at which the hook 40 extends passed the vertical frame member 22 is then adjusted by placing the selected horizontal leverage bar 32 between two of the perpendicular rods 38. The perpendicular rods 38 are spaced to allow the horizontal leverage bars 32 to fit therebetween while also holding the handle assembly 18 in position when assembled.

At this time the chain assembly 20 is now wrapped around the pole or post 12 and positioned in an engaged position with the hook 40. The swivel connection 46 is then connected to one link 44 of the chain 42 to secure the post or pole 12 within a loop formed by interconnection of the chain 42 and swivel connection 46. The hand operated post and pole extraction device 10 is now ready for use.

In order to extract the pole or post 12 from its set position in the ground 14 all the user need do is to apply a force on the handle section 34 towards the ground 14, i.e. in the direction of the arrows labeled 47. Application of a force in this direction will cause the extending arm 36 to pivot in the opposite direction about the horizontal leverage bar 32 on which it is held. Pivoting of the extending arm 36 causes the hook to exert a force on the chain assembly 20 and thereby exert a force on the pole or post 12 in the direction indicated by the arrows labeled 49, i.e. away from the ground. The pole or post 12 will thus be pulled or extracted from the ground 14. If the pole or post 14 is set deep in the ground 14, once the handle section 34 is forced to contact the ground 14 the swivel connection 46 must be disengaged from the link 44 of the chain 42 and the chain re-wrapped around the pole or post 12. The swivel connection 46 is then reconnected to a link 44 of the chain 42 and a force is again applied in the direction of the arrows labeled 47 to the handle section 34. This process is repeated until the pole or post is extracted from the ground 14.

Once the pole or post is extracted from the ground 14, the hand operated post and pole extraction device 10 can be disassembled for storage. The swivel connection is first disengaged from the link 44 of the chain 42 and the chain assembly 20 is disengaged from the hook of the extension arm 36. The extension arm 36 is then removed from its position held atop one of the horizontal leverage bars 32. The connection bar 48 is then removed from its position within the extension arm 36. The hand operated post and pole extraction device 10 is now disassembled and can be easily stored in a compact manner until needed again.

From the above description it can be seen that the hand operated post and pole extraction device of the present invention is able to overcome the shortcomings of prior art devices by providing a hand operated post and pole extraction device which is compact in construction, easily handled by a single person and able to efficiently and economically remove posts and poles set in the ground. The hand operated post and pole extraction device which is readily transportable and in use is positioned in front of the post or pole to be extracted at a distance a chain connected thereto can be wrapped around the post or pole. The hand operated post and pole extraction device uses leverage and pivoting of a handle about a leverage point to extract the post or pole from its set position in the ground. Furthermore, the hand operated post and pole extraction device of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hand operated post and pole extraction device for readily removing a pole or post from a position set within the ground, said hand operated post and pole extraction device comprising:

a) a frame assembly including a base section, a vertical frame member extending from said base section and a plurality of spaced, horizontal leverage arms extending from and substantially perpendicular to said vertical frame member;

b) an elongated handle assembly with first and second ends pivotally held atop a selected leverage arm having the first end adjacent the post or pole to be extracted;

c) a chain assembly removably connected to said first end of said handle assembly wrapped around said post or pole to be extracted, wherein said chain assembly extracts said pole or post when a force is applied to the second end of said handle assembly, said handle assembly pivoting about said selected leverage arm;

d) a leverage assembly mounted on the underside of said handle assembly extending from said first end thereof comprising an elongated flat bar attached to said handle assembly, a plurality of parallel, spaced rods mounted on said flat bar extending at right angles to the length of said flat bar, and a hook mounted on said flat bar adjacent said first end of said handle assembly, the open portion of said hook facing away from said post or pole, said flat bar resting on said selected leverage arm with one of said spaced rods engaging said selected leverage arm; and e) said chain assembly comprising a length of chain links having a swivel connection at one end to engage a link of said chain when said chain is wrapped about said pole or post to be extracted, another link of said chain engaging said hook, so that said post or pole is solely in contact with said chain assembly of said device during extraction.

2. The hand operated post and pole extraction device as recited in claim 1, wherein said frame assembly further includes an upright support member extending at an angle from said vertical frame member for providing additional support to said frame assembly.

3. The hand operated post and pole extraction device as recited in claim 2, wherein said upright support member includes a base and an angled section extending from said base and secured to said vertical frame member.

4. The hand operated post and pole extraction device as recited in claim 3, wherein said base is flared to provide a larger surface area and additional support to the frame assembly.

5. The hand operated post and pole extraction device as recited in claim 1, wherein said handle assembly includes a handle section and an extending arm removably connected to said handle section.

6. The hand operated post and pole extraction device as recited in claim 5, wherein said handle section and said extension arm are both hollow and said handle assembly further includes a connection bar integrally connected within and extending from said handle section, whereby said connection bar is removably positioned to extend into said hollow extension arm.

7. The hand operated post and pole extraction device as recited in claim 1, wherein said frame assembly is coated in a non-corrosive material.

8. The hand operated post and pole extraction device as recited in claim 7, wherein said non corrosive material is one of a gray or black paint.

* * * * *